US007651045B2

(12) United States Patent
Raunisto

(10) Patent No.: US 7,651,045 B2
(45) Date of Patent: Jan. 26, 2010

(54) CRUSHING OR CUTTING DEVICE

(75) Inventor: Yrjo Raunisto, Hameenlinna (FI)

(73) Assignee: Kinshofer GmbH, Waakirchen (DE)

( * ) Notice: Subject to any disclaimer, the term of this patent is extended or adjusted under 35 U.S.C. 154(b) by 256 days.

(21) Appl. No.: 11/718,050

(22) PCT Filed: Oct. 28, 2005

(86) PCT No.: PCT/FI2005/000466

§ 371 (c)(1),
(2), (4) Date: Apr. 26, 2007

(87) PCT Pub. No.: WO2006/045890

PCT Pub. Date: May 4, 2006

(65) Prior Publication Data

US 2009/0140090 A1 Jun. 4, 2009

(30) Foreign Application Priority Data

Oct. 28, 2004 (FI) ..... 20041391

(51) Int. Cl.
*B02C 1/06* (2006.01)

(52) U.S. Cl. ..... 241/266

(58) Field of Classification Search ..... 241/264–269
See application file for complete search history.

(56) References Cited

U.S. PATENT DOCUMENTS 4,406,416 A 9/1983 Tateishi
4,927,089 A 5/1990 Altmayer

FOREIGN PATENT DOCUMENTS

JP 4153468 5/1992
JP 4300654 10/1992

*Primary Examiner*—Mark Rosenbaum
(74) *Attorney, Agent, or Firm*—Stites & Harbison PLLC; Douglas E. Jackson

(57) ABSTRACT

A crushing or cutting device comprising a body (6), crushing/cutting jaws (1) making, rotation and attached to the body by means of one or several shafts (5), a first power unit (3) to move said jaws against each other, whereby at least one shaft (5) of jaw (1) is fitted with bearings to rotate in regard both to body (6) and jaw (1) and the said bearings are eccentric among themselves and the device has a second power unit (4) in order to rotate at least one said shaft (5). The second power unit (4) is fitted to press jaws (1) against each other in multiplying the motive force of the second power unit (4) between eccentricity distance (e) of the bearings and by means of a torsion arm longer than said eccentricity distance (e) connected to the shaft, in a situation, where shaft (5) is rotated 180° at the most, and when the first power unit (3) is hydraulically locked or in a position pressing the jaws against each other.

8 Claims, 2 Drawing Sheets

CRUSHING OR CUTTING DEVICE

The invention relates to a crushing or cutting device comprising a body, crushing/cutting jaws making, rotation and attached to the body by means of one or several shafts, a first power unit to move said jaws against each other, whereby at least one jaw shaft is fitted with bearings to be rotating both in regard to body and jaw, and said bearings of the shaft are eccentric among themselves and the device has a second power unit in order to rotate at least one said shaft.

In known crushing devices the jaws are pressed against each other with great force with the intent to a the piece between jaws crush. If no crushing takes place a new grip with the jaws must be taken from another spot. Usually the constructions to be crushed are crush-resistant, but fragile, as concrete constructions. They may endure the pressing of jaws and thus aggravate the crushing.

Further, previously known from published Japanese application JP4300654 is a crushing device, where the crushing jaws are by means of rotating shafts attached to the body of the device. The shafts have in the body and in the jaws bearing surfaces eccentric among themselves. The shafts are rotated by means of a hydraulic motor so that by suitable frequency working vibration is achieved for the jaws. By means of vibrating function the object to be crushed or is crushed can be ground smaller. By means of the vibrating function. it is not meant to increase the crushing force of the jaws. The crushing force of the jaws is even made smaller or gets smaller by vibration.

In order to intensify pressing and crushing or cutting by means of it taking place by means of it, it is proposed as a now presented invention a new additional function connectable to a crushing device, by means of which crushing and cutting can be considerably intensified when needed, if the jaw force is not sufficient to crush the piece. The crushing and cutting device according to the invention is characterized in that one power unit is fitted to press the jaws against each other in multiplying the motive force of the second power unit between eccentricity distance e of bearings and by means of a torsion arm longer than said eccentricity distance e connected to the shaft, in a situation where the shaft is rotated 180° at the most, and when the first power unit is hydraulically locked or in a position pressing the jaws against each other.

The considerable advantage of the invention is that in addition to the straight pressing of jaws there is available for the jaws an additional motion to press and at the same time to rub the piece, which motion in most cases is sufficient to crush the piece. Even an additional pressing of 100-200% is achieved by means of rotation of the eccentric shafts, when the proper pressing cylinder is locked immobile by locking the fluid pressure channels leading to it. The proper pressing cylinder can also be kept pressurized in maximum pressure, so it can immediately continue its motion, when by means of the second power unit the jaws have been made to penetrate to the object. Furthermore, the eccentric shaft in pressing jaw produces a motion in a direction, deviating from the pressing direction.

The other embodiments of the invention are characterized in that what is presented in the dependent claims.

In the following the invention is disclosed with reference to the enclosed drawing, where:

Figure 7:
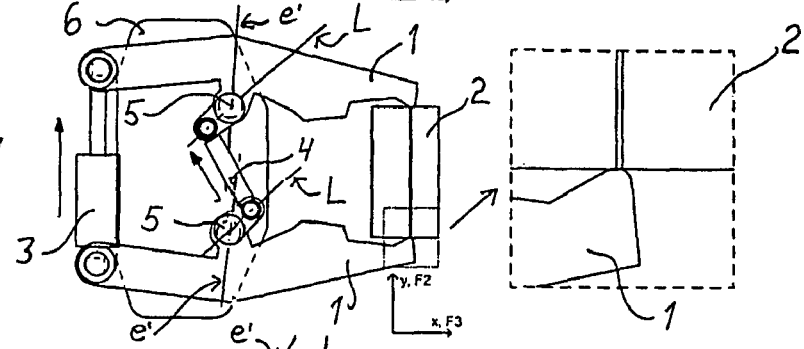

FIG. 7 the pair of jaws, when the pressing by eccentric power unit get started.

Figure 8:
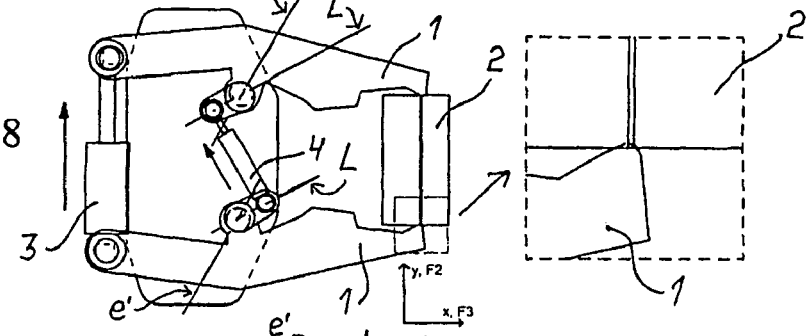

FIG. 8 shows the pair of jaws, when the pressing by eccentric power unit advances.

Figure 9:
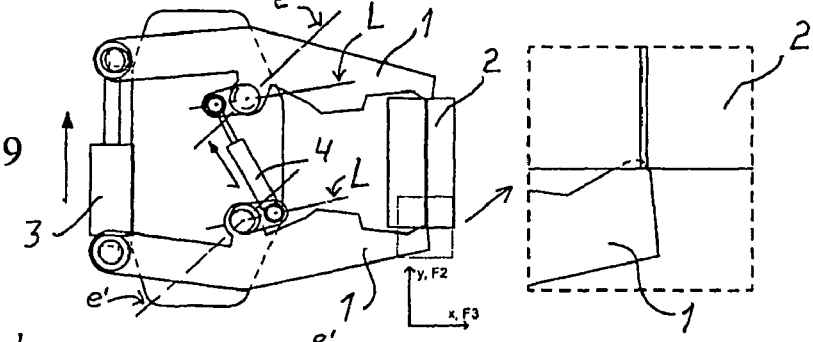

FIG. 9 shows the pair of jaws, when the pressing by eccentric power unit advances.

Figure 10:
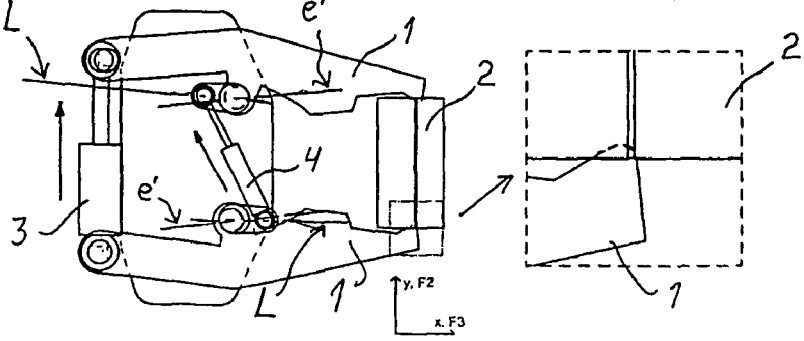

FIG. 10 shows the pair of jaws, when by eccentric power unit the travel of pressing ends.

Figure 1:
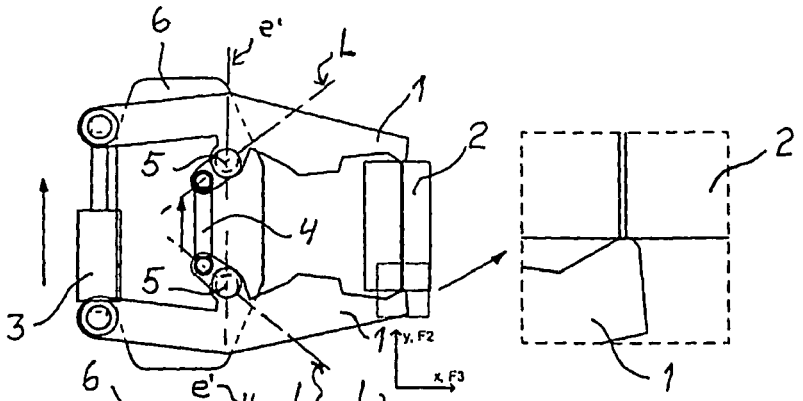
FIG. 1 shows the pair of jaws and a power unit the at the beginning of pressing.

FIG. 1 shows a jaw crusher, which has a body 6, jaws 1 attached to it by means of rotating shafts 5 and a hydraulic cylinder 3 as crushing power unit. There are in shafts 5 separate bearing portions for jaws 1 and body 6. The centres of the separate bearing portions also deviate from each other as much as eccentricity e arranged between the centres. In FIG. 1 the eccentricity distance e is between the centres marked in the figure in direction e' that is upwards. Distance e is so small that it is not marked in the figures. Shafts 5 are rotated by means of a lever attached to them affecting the lever head by means of the force generated by means of cylinder 4. The lever length is manifold compared with the eccentricity distance e. In the position of FIG. 1 the eccentricity e is, as to its direction, of that kind that jaws 1 are in their farthest position in regard to each other. The adjacent enlarged figure shows jaw 1 just on the surface of piece 2, which is to be crushed. Cylinder 4 is also in its shortest position.

Figure 2:
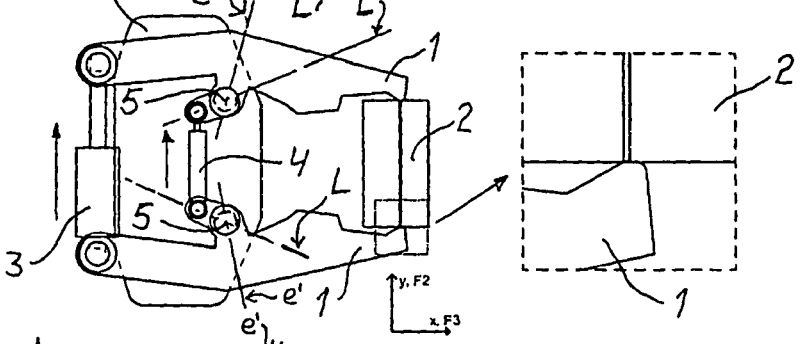
FIG. 2 shows the pair of jaws, when the pressing by eccentric power unit gets started.

In FIG. 2 second cylinder 4 has shafts 5 rotated a little by means of levers, but eccentricity e has not yet affected jaws 1 as much increasing pressing as worth to mention nor the movement of jaws sideways.

Figure 3:
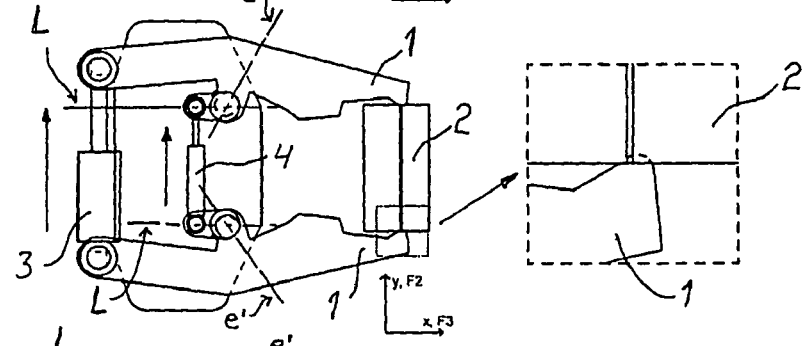
FIG. 3 shows the pair of jaws, when the pressing by eccentric power unit advances.

In FIG. 3 second cylinder 4 has clearly rotated shafts 5, while the lever directions have been rotating horizontally. The direction of eccentricity distance e has also deviated remarkably from the vertical. Jaw 1 has a firm grasp of the piece 2 also moved sideways to the right from its original line.

Figure 4:
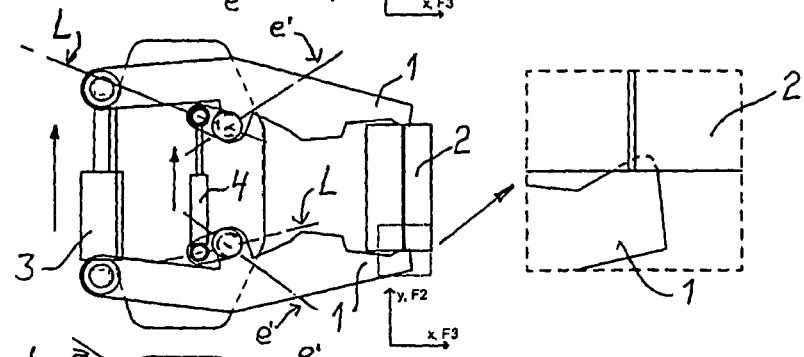
FIG. 4 shows the pair of jaws, when the pressing by eccentric power unit advances.

FIG. 4 shows even more and even better the motions taken place to line L, the direction of distance e and the travel of jaw 1. Jaw 1 has also got more pressing, if piece 2 has caused it with its counterforce.

Figure 5:
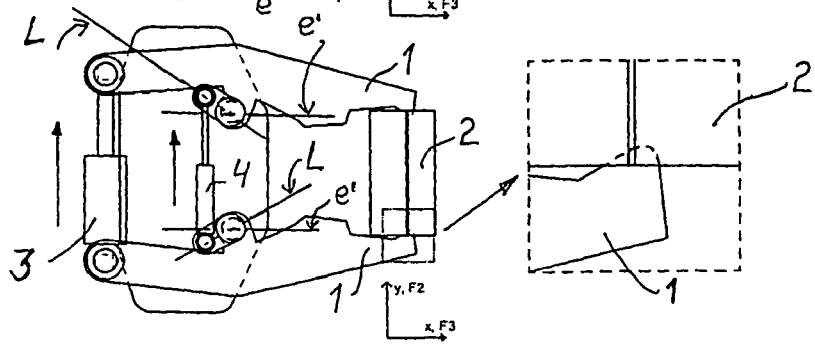
FIG. 5 shows the pair of jaws, when by eccentric power unit the travel of pressing ends.

FIG. 5 shows the final situation, whereby the margin of cylinder 4 ends and direction L of the lever has turned off from the advantageous direction. Direction e' is also already horizontal, whereby additional rotating of shaft 5 would start to reduce the additional pressing of jaws, which could be achieved by means of the second cylinder 4.

Figure 6:
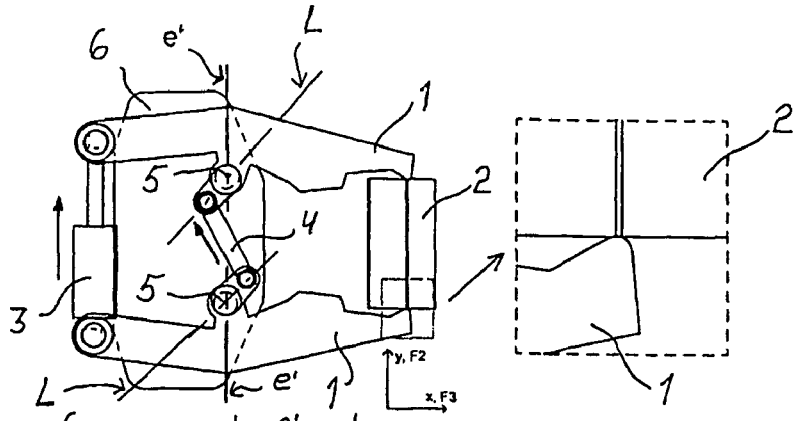
FIG. 6 shows the pair of jaws and a power when the of pressing starts.

FIG. 6 shows connection of the second power unit 4 by means of levers crosswise to shafts 5. In this way such a change to the motion of jaws 1 is achieved that lower jaw 1 begins to move gradually towards the left side, while adding pressing by power unit 4, which takes place rotating shafts 5, whereas the upper jaw 1 moves towards the right side, such as both jaws 1 moved in the case of FIGS. 1-5.

Attachment of cylinder 4 to two levers results in that the cylinder 4 motion is "floating". In other words, the levers do not necessarily rotate in same pace. In most cases this may be an advantage and improve the crushing property, since the illogical motions of jaws 1 among each other produce several different tensions into the piece to be crushed. Thus it is possible that a direction is easily found, where the piece gets crushed even with less force.

While power unit 4 is rotating shafts 5, the pressure line can be kept open to the proper cylinder 3, which forms the proper crushing force and this then tenses jaws 1 by a crushing force corresponding to the pressure. Then the second power unit 4 produces only sideways motions of jaws 1. If the first power unit 3 transmits maximum crushing force to jaws 1 by means of its maximum working pressure and it will then be locked by closing the hydraulic channels running to it, the power unit 3 can take even greater load before the back-up system lets out hydraulic liquid from the cylinder in case of overloading. Therefore by means of power unit 4 and due to the eccentric shaft and the lever longer than the eccentric travel e, attached to it, it is possible to cause in the jaws a still greater pressing than to which power unit 3 is able. The addition of crushing force can even be 100-200%. When yet to the crushing force produced by means of power unit 4 the sideways motion of jaws is added the crushing force improves remarkably thanks to the presented invention. The lever length counted from the centre of the cylinder head to the centre of shaft 5 is most suitably more than 5 times the eccentric travel e, which is the distance between the centres fixed bearings. Most suitably the lever length is, however, 10 times more than travel e.

The invention claimed is:

1. A crushing or cutting device comprising: a body, crushing/cutting jaws making rotation and attached to the body by one or several shafts, a first power unit to move said jaws against each other, whereby at least one said shaft of said jaw is fitted with bearings to rotate in regard both to said body and whereby said jaw and said bearings are eccentric among themselves, and the device has a second power unit in order to rotate at least one said shaft, characterized in that said second power unit is fitted to press said jaws against each other in multiplying the motive force of the second power unit between an eccentricity distance of the bearings and by a torsion arm longer than said eccentricity distance connected to the shaft, in a situation, where at least one said shaft is rotated 180° at the most, and when the first power unit is hydraulically locked or in a position pressing the jaws against each other.

2. A device according to claim 1 characterized in that by said eccentricity distance of said shaft the rotation of said shaft is fitted to move said jaw in a direction deviating from the pressing direction.

3. A device according to claim 1 characterized in that there is one said shaft per each said jaw and the second power unit is fitted to move both said shafts in different rotation directions.

4. A device according to claim 1 characterized in that said second power unit is fitted to move both said shafts in the same rotation direction.

5. A device according to claim 1 characterized in that the second power unit is fitted to rotate said shaft back and forth.

6. A device according to claim 1 characterized in that said second power unit is a hydraulic cylinder and a length of a lever led from said hydraulic cylinder to said shaft is at least 5 times as much as the eccentric distance.

7. A device according to claim 6 characterized in that the length of the lever is 10 times as much as the eccentric distance.

8. A device according to claim 1 characterized in that the second power unit is fitted to rotate two said shafts, whereby said second power unit is freely attached between heads of levers connected to said shafts.

* * * * *